US007335084B2

(12) United States Patent
Sato

(10) Patent No.: US 7,335,084 B2
(45) Date of Patent: Feb. 26, 2008

(54) TRAVELING TOY AND SUSPENSION OF TRAVELING TOY

(75) Inventor: Shigeharu Sato, Tokyo (JP)

(73) Assignee: Nikko Co., Ltd., Tokyo (JP)

( * ) Notice: Subject to any disclaimer, the term of this patent is extended or adjusted under 35 U.S.C. 154(b) by 268 days.

(21) Appl. No.: 10/540,218

(22) PCT Filed: Dec. 19, 2002

(86) PCT No.: PCT/JP02/13319

§ 371 (c)(1),
(2), (4) Date: Jun. 20, 2005

(87) PCT Pub. No.: WO2004/056437

PCT Pub. Date: Jul. 8, 2004

(65) Prior Publication Data

US 2006/0057934 A1 Mar. 16, 2006

(51) Int. Cl.
*A63H 17/26* (2006.01)

(52) U.S. Cl. ..... 446/469; 446/468; 446/466; 446/465

(58) Field of Classification Search ..... 446/469, 446/468, 466, 465
See application file for complete search history.

(56) References Cited

U.S. PATENT DOCUMENTS 1,563,547 A * 12/1925 Bovee ..... 267/255
2,531,933 A * 11/1950 Clark ..... 267/289
2,836,254 A * 5/1958 Boehner ..... 180/56
3,039,788 A * 6/1962 Farago ..... 280/124.142
3,412,505 A 11/1968 Mills
4,159,126 A 6/1979 Raleigh
4,696,655 A * 9/1987 D'Andrade et al. ..... 446/466

(Continued)

FOREIGN PATENT DOCUMENTS

DE 299 22 520 3/2000

(Continued)

OTHER PUBLICATIONS

Microfilm of the specification and drawings annexed to the request of Japanese Utility Model Application No. 24576/1978 (Laid-open No. 128593/1979) (Takara Co., Ltd.), Sep. 7, 1979, Full text; Figs. 1 to 2.

(Continued)

*Primary Examiner*—Eugene Kim
*Assistant Examiner*—Urszula Cegielnik
(74) *Attorney, Agent, or Firm*—Young & Thompson

(57) ABSTRACT

A traveling toy having a plurality of steering front wheels and a plurality of rear wheels being connected with a driver, and a suspension of traveling toy in which a trailing arm having one end part supported rotatably at the upper part of a supporting wall standing from the chassis of the traveling toy at one end thereof, a first central hole part for passing a hollow tubular section projecting from the chassis through a specified interval from the supporting wall, a spring part interposed while being energized between a threaded part on top of the hollow tubular section and the end part of the first hole part, and a second hole part opening in the horizontal direction at the other end part serves to pass the axle of rear wheels through the second hole part thus absorbing a shock transmitted from the axle through the spring.

12 Claims, 6 Drawing Sheets

U.S. PATENT DOCUMENTS

| | | | | |
|---|---|---|---|---|
| 4,892,502 | A | 1/1990 | Hesse | |
| 5,056,764 | A * | 10/1991 | Mochizuki | 267/291 |
| 5,108,126 | A * | 4/1992 | Banse | 280/86.757 |
| 5,306,038 | A * | 4/1994 | Henderson, Jr. | 446/466 |
| 5,312,288 | A * | 5/1994 | Williams | 446/468 |
| 5,338,246 | A * | 8/1994 | Suto | 446/466 |
| 5,795,576 | A * | 8/1998 | Diaz et al. | 424/738 |
| 6,264,528 | B1 * | 7/2001 | Doan et al. | 446/424 |
| 6,383,054 | B1 | 5/2002 | Rauch | |
| 6,394,878 | B1 * | 5/2002 | Wang | 446/469 |
| 6,439,948 | B1 * | 8/2002 | Ostendorff et al. | 446/154 |
| 6,478,655 | B2 * | 11/2002 | Wu | 446/456 |
| 6,764,376 | B2 * | 7/2004 | Agostini et al. | 446/466 |
| 6,796,874 | B2 * | 9/2004 | Harada | 446/468 |
| 2003/0003843 | A1 * | 1/2003 | Edmisson et al. | 446/466 |
| 2005/0250413 | A1 * | 11/2005 | Lo et al. | 446/427 |

FOREIGN PATENT DOCUMENTS

| | | |
|---|---|---|
| DE | 201 05 614 | 8/2002 |
| JP | 43-25303 | 10/1943 |
| JP | 57-27517 | 6/1982 |
| JP | 4-874 | 1/1992 |
| JP | 6-17503 | 5/1994 |

OTHER PUBLICATIONS

Microfilm of the specification and drawings annexed to the request of Japanese Utility Model Application No. 21280/1979 (Laid-open No. 119790/1980) (Kondo Kabushiki Kaisha), Aug. 25, 1980, Full text; Figs. 1 to 2.

* cited by examiner

TRAVELING TOY AND SUSPENSION OF TRAVELING TOY

TECHNICAL FIELD

The present invention relates to a running toy rear suspension and, more particularly to a running toy and a running toy suspension system, in which right-and-left wheels and a gearbox operate independently to each other, on top of that, the structure may be simplified.

BACKGROUND ART

In general, some running toys have suspension systems to seek after improvement of running stability by connecting the vehicle body to the axles through springs, links, and shock absorbers to ease a shock from a road surface for protecting the running toys, as well as performing proper vibration control, due to suffering from the effect of a faulty road surface during running. Conventionally, a suspension system employed for a vehicle toy includes a semi-double wishbone, a double wishbone, a semi-double trailing arm, a double trailing arm, a semi-trailing arm, a trailing arm, a swing arm, rigid, and the like.

FIG. 6 shows that, for example, an axle 6 and a gearbox 36 are combined in one, and a bushing 48 projects to a front side portion of the gearbox 36 on either side, respectively, being inserted into an elliptical-shaped opening 50 provided in the vehicle body, while a rear portion of the gearbox 36 is suspended from the vehicle body by a spring built-in suspension 52.

At the same time, reference literature includes Japanese Utility Model Publication No. 43-25303, U.S. Pat. No. 3,412,505, U.S. Pat. No. 4,159,126, and U.S. Pat. No. 4,892,502.

A running toy requires a low price at first. Hence, FIG. 5 comprises only the suspension, the gearbox, and the vehicle body, thus resulting in less number of parts and less manufacturing processes to enable low-priced manufacturing.

However, direct connection of the gearbox 36 to the suspension 52 results in direct transmission of a shock to the gearbox 36, as well as insufficient smooth operation.

Moreover, it is only the stiffness of a spring, the size, and the like thereof to adjust the present suspension, making almost impossible its adjustment.

On top of that, little or no independence of the right-and-left suspension makes it impossible to respond to a tire lift when exceeding limits of the contractility and extensibility of a spring, which may cause a unilateral tire to be lifted.

Whereat, an object of the present invention is to provide a running toy and a running toy suspension system which are low in price, smooth operation, and somewhat adjustable, and which have the right-and-left independence.

DISCLOSURE OF THE INVENTION

To solve said problems, the invention of claim 1 according to the present invention provides a running toy having a plurality of front wheels for steering and a plurality of rear wheels connected to a running gear, a trailing arm comprising:

a first end portion which is pivotally supported on an upper portion of a supporting wall set up on a vehicle body of a running system at one end thereof;

a first hole portion, which is provided in a central portion of a trailing arm, for allowing a protruded hollow cylinder portion to pass trough, and the protruded hollow cylinder portion provided on said vehicle body with a predetermined space from the supporting wall;

a spring portion which is set and applied between a screw portion provided on the top of the hollow cylinder portion and an end portion of the first hole portion; and a second hole portion which opens in a horizontal direction to the other end portion, wherein said trailing arm allows an axle of the rear wheels to be passed through this second hole portion and said spring to absorb a shock transmitted from the axle of the rear wheels.

The number of wheels of the running toy here is not limited to four wheels, but rather may be more number. And, the first hole portion denotes a "hole portion" in the specification. Furthermore, the second hole portion denotes an "axle through-hole portion."

The present invention according to claim 2 provides a running toy, wherein in one end portion of a trailing arm, a bushing which is projected in a horizontal direction, on top of that, vertically and cylindrically to a traveling direction is formed, inserted into a U-shaped groove portion provided on upper portions of two supporting walls provided on a vehicle body, and pivotally supported.

Here, the bushing is inserted into the U-shaped groove portion, but if an O-shaped hole portion is provided on the supporting wall, and the like set up in the vehicle body beforehand, the same as the U-shaped groove portion is possible.

The present invention according to claim 3 provides a running toy, wherein a trailing arm is provided with a hole portion passing through in a vertical longitudinal direction in the middle thereof, the hole portion having the same diameter as that of a hollow cylinder in a lower portion, and, in an upper portion, a larger diameter than that of the lower portion, and wherein the lower portion opens and covers a vehicle body, whereas the upper portion opens in the other side of the vehicle body, and a stepped portion is provided therebetween.

As used herein, the term, the hole portion having the same diameter as that of the hollow cylinder, indicates that the hole portion is big enough to make an the hollow cylinder slidable.

The present invention according to claim 4 provides a running toy, wherein a spring is set between a stepped portion of a first hole portion and applying force of the spring is adjusted depending on how to tighten the screw to be fixed.

The present invention according to claim 5 provides a running toy, wherein trailing arms are disposed at both ends of a rear portion of a vehicle body, and a gearbox to change gears of a running gear is disposed between both the trailing arms.

The present invention according to claim 6 provides a running toy, wherein a trailing arm is rotationally held between an axle cover extending from a gearbox, and the gearbox.

The present invention according to claim 7 provides a running toy suspension system having a plurality of front wheels for steering and a plurality of rear wheels connected to a running gear, a trailing arm comprising:

a first end portion which is pivotally supported on an upper portion of a supporting wall set up on a vehicle body of a running system at one end thereof;

a first hole portion, which is provided in a central portion of a trailing arm, for allowing a protruded hollow cylinder portion to pass trough, and the protruded_hollow cylinder portion provided on said vehicle body with a predetermined space from the supporting wall;

a spring portion which is set and applied between a screw portion provided on the top of the hollow cylinder portion and an end portion of the first hole portion; and a second hole portion which opens in a horizontal direction to the other end portion, wherein said trailing arm allows an axle of the rear wheels to be passed through this second hole portion and said spring to absorb a shock transmitted from the axle of the rear wheels.

The present invention according to claim 8 provides a running toy suspension system, wherein in one end portion of a trailing arm, a bushing which is projected in a horizontal direction, on top of that, vertically and cylindrically to a traveling direction is formed, inserted into a U-shaped groove portion provided on upper portions of two supporting walls provided on a vehicle body, and pivotally supported.

The present invention according to claim 9 provides a running toy suspension system, wherein a trailing arm is provided with a hole portion passing through in a vertical longitudinal direction in the middle thereof, the hole portion having the same diameter as that of the hollow cylinder in a lower portion, and, in an upper portion, a larger diameter than that of the lower portion, and wherein the lower portion opens and covers a vehicle body, whereas the upper portion opens in the other side of the vehicle body, and a stepped portion is provided therebetween.

The present invention according to claim 10 provides a running toy suspension system according to any one of claims 7 to 9, wherein a spring is set between a stepped portion of a first hole portion and applying force of the spring is adjusted depending on how to tighten the screw to be fixed.

The present invention according to claim 11 provides a running toy suspension system, wherein trailing arms are disposed at both ends of a rear portion of a vehicle body, and a gearbox to change gears of a running gear is disposed between both the trailing arms.

The present invention according to claim 12 provides a running toy suspension system, wherein a trailing arm is rotationally held between an axle cover extending from a gearbox, and the gearbox.

BEST MODE FOR CARRYING OUR THE INVENTION

Other details, advantages, and features of the present invention will be more apparent upon reading the following embodiments with reference to the accompanying drawings.

Figure 5:
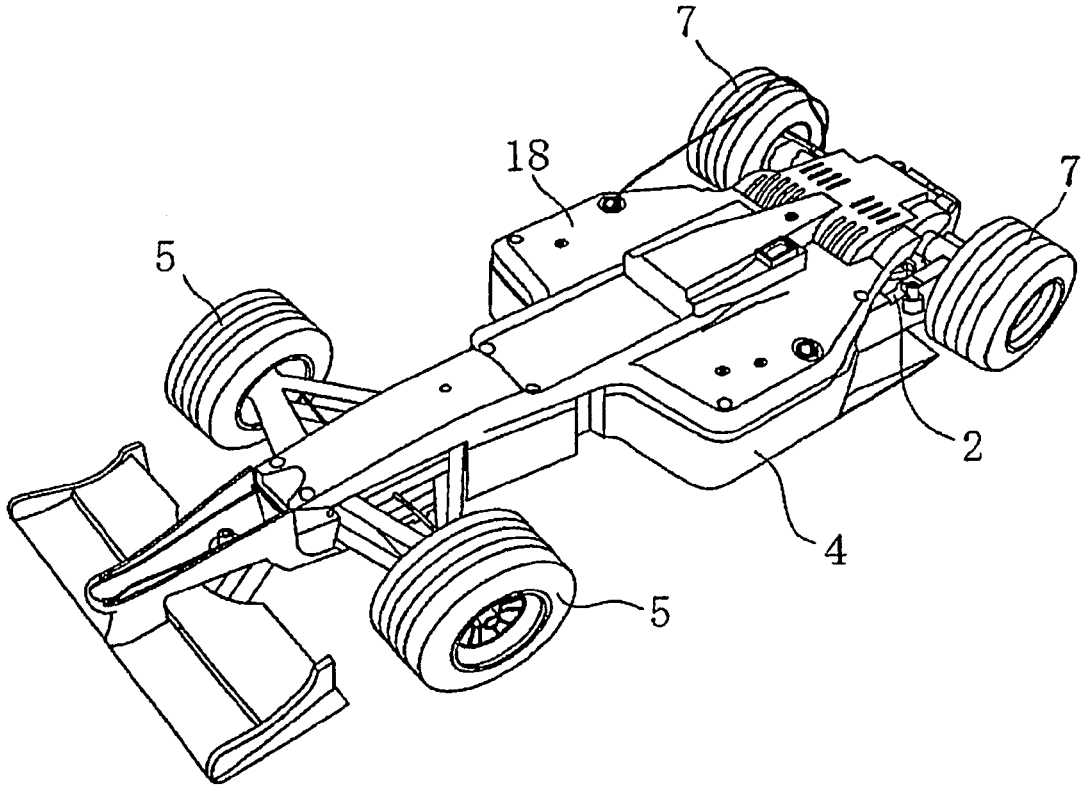
FIG. 5 is a perspective view showing an embodiment of a running toy according to the present invention.
Figure 6:
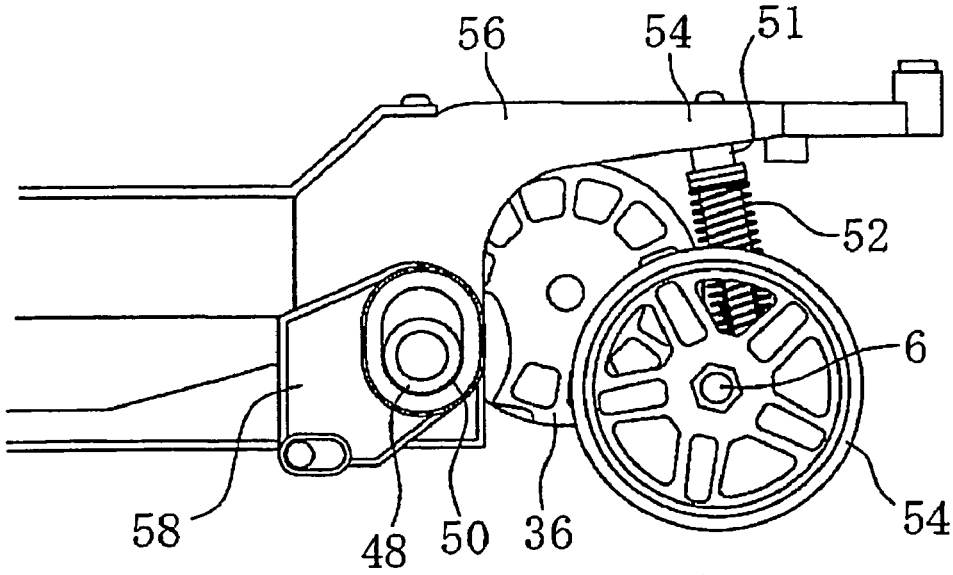
FIG. 6 is a conventional running toy suspension system 1.

A running toy 3 which mounts a running toy suspension system 1 according to the present invention has front wheel tires 5, rear wheel tires 7, and a running gear 9 in a vehicle body 4, as shown in FIG. 5. The running toy suspension system 1 is a system used to join the rear wheel tires 7 to the vehicle body.

Figure 1:
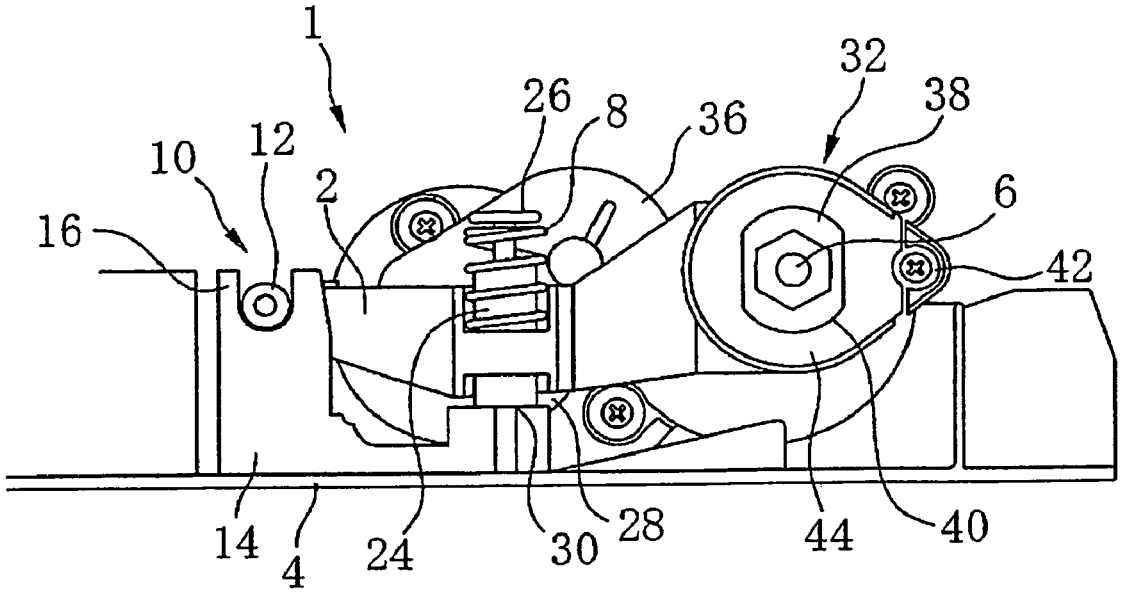
FIG. 1 is a side view showing an embodiment of a running toy suspension system 1 according to the present invention.
Figure 2:
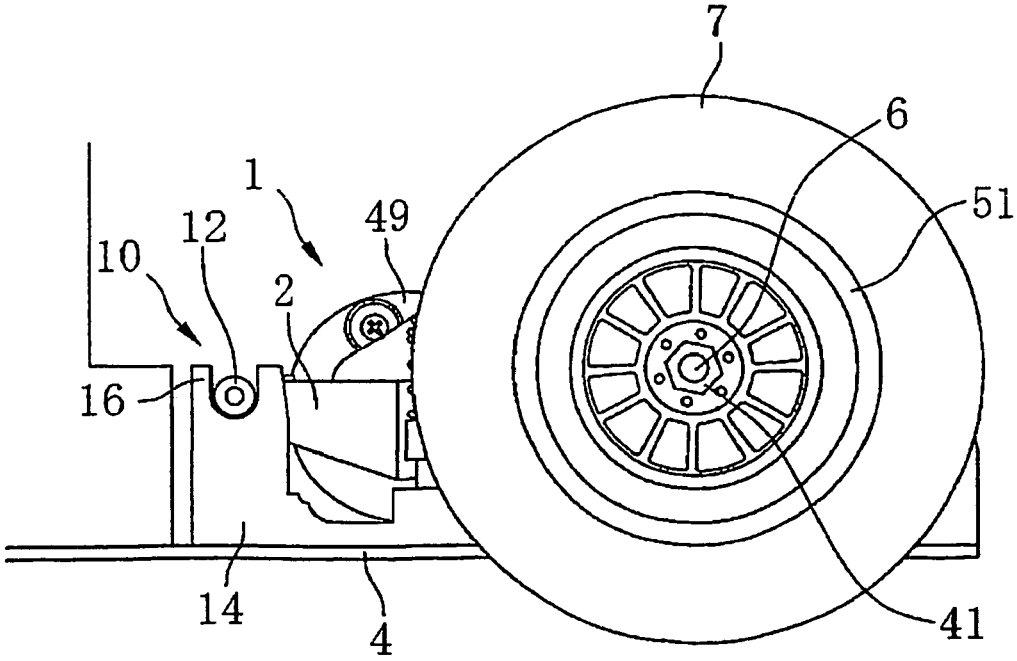
FIG. 2 is a side view showing an embodiment of a running toy suspension system 1 according to the present invention.
Figure 3:
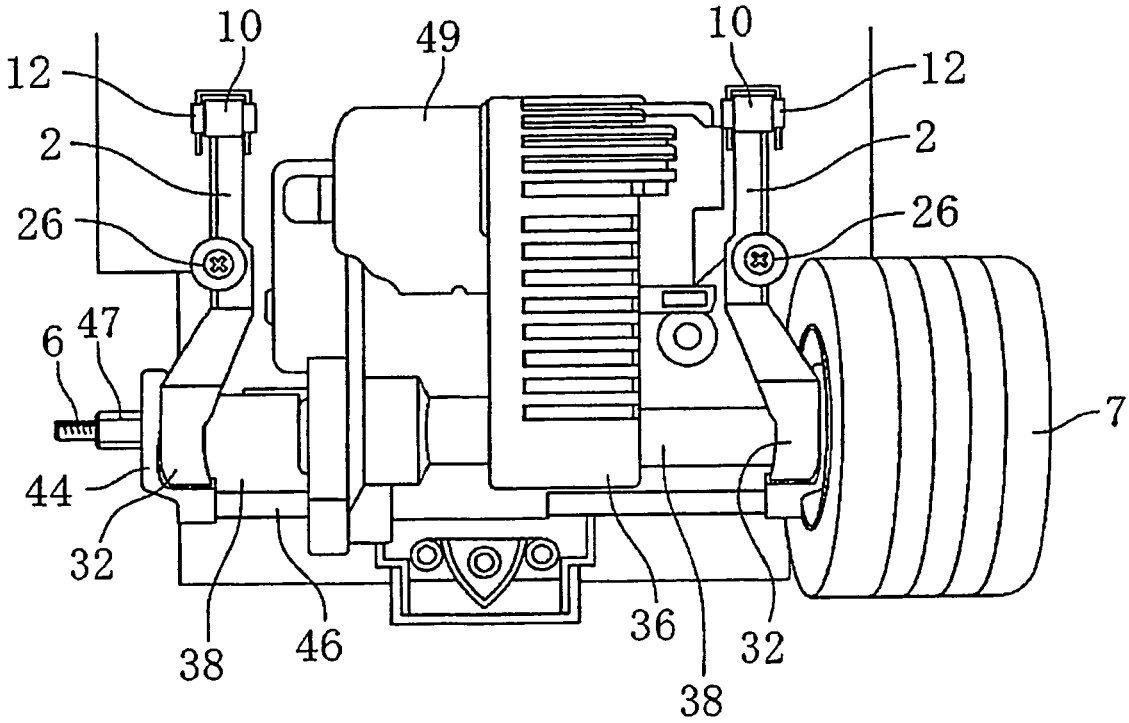
FIG. 3 is a plan view showing an embodiment of a running toy suspension system 1 according to the present invention.

FIG. 1 shows a side view of the running toy suspension system 1 from which the rear wheel tires 7 are removed to clarify the system of the present invention. A state where the rear wheel tires 7 are mounted is shown in FIG. 2. And, a plan view from which one rear wheel tire 7 is removed for illustrative purposes is shown in FIG. 3. As shown in FIG. 1, in the running toy suspension system 1 according to the present invention, a trailing arm 2, of which one end is rotationally held to the vehicle body 4, and the other end is connected to an axle 6 is disposed so as to be vertically movable to the vehicle body 4 through a compression spring 8 in the middle thereof.

Figure 4:
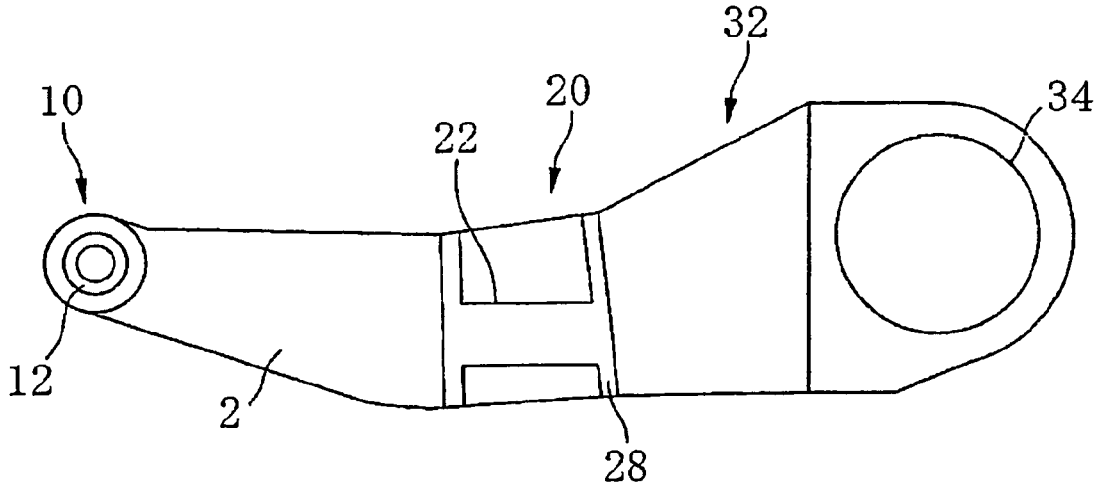
FIG. 4 is a side view showing a trailing arm of a running toy suspension system 1 according to the present invention.

One end 10 of the trailing arm 2 is machined into a cylinder shape, and bushings 12 with a diameter smaller than this cylinder further project in a horizontal direction on both sides, on top of that, perpendicular to a traveling direction (FIG. 4). On the other hand, bearings 16 which are notched in a U shape are provided on upper portions of two supporting walls 14 set up from the vehicle body 4, the bushings 12 being pivotally supported by the bearings 16. The bearings 16 act as operating points of the trailing arms 2. Here, since a vehicle body cover 18 is not described in FIG. 1 for illustrative purposes, an upper portion of the bearing 16 is opened on the drawings. However, the vehicle body cover 18 is actually put on the vehicle body 4 in order that the running toy mounting the running toy suspension system according to the present invention runs (refer to FIG. 5). For this reason, the upper portion of the bearing 16 is closed, and the bushing 12 is restricted to move to the upper direction, therefore, the bushing 12 is allowed to rotate only within the bearing 16.

A hole portion 20 is provided in the middle of the trailing arm 2, the hole portion 20 perpendicular to projecting direction of the bushing 12. This hole portion 20 has a different diameter between the upper portion and lower portion, the lower portion being smaller than the upper portion. Thus, a stepped portion 22 is provided in a boundary between the upper portion and the lower portion. Furthermore, there are no side walls on one side of the upper portion, namely, the other side (the other side of the vehicle body) of the side in abutment with the vehicle body 4.

In this regard, a hollow cylinder 24 is set up in a rear portion of the vehicle body 4 with the predetermined space from the supporting wall 14, the hollow cylinder 24 as high as the axle. This hollow cylinder 24 passes through said hole portion 20. A washer screw 26 is screw-fixed to the edge of the passed-through hollow cylinder 24, and a compression spring 8 energized in a direction disengaging the washer screw 26 and the stepped portion 22 is set therebetween.

Therefore, the trailing arm 2 is controlled by the washer screw 26 and the compression spring 8 with respect to an upper direction. On the other hand, with respect to a lower direction, the trailing arm 2 is controlled at a location at which a bottom portion 28 in the middle of the trailing arm 2 and a hollow cylinder supporting portion 30 provided in a lower side portion of the hollow cylinder 24 are locked.

A rear end portion 32 which is another end of the trailing arm 2 is extended as a result of tilt of an arm axle toward the other side of the vehicle body, curved halfway and extended parallel to the vehicle body 4 again (FIG. 3). An axle through-hole portion 34 is provided at this rear end 32 in a parallel direction. The axle through-hole portion 34 is passed through by an axle cover 38 extending from a gearbox 36 which serves to convert the speed and torque of a driving portion including an axle 6, the driving portion which causes a running toy to drive. Since the interior diameter of the axle through-hole portion 34 is slightly larger than the external diameter of the axle cover 38, the trailing arm 2 is rotationally fixed to the axle cover 38. Moreover, the axle cover 38 having passed through the axle through-hole portion 34 of the trailing arm 2 further passes through a locking portion 44 having a lock through-hole portion 40 and screw fixation hole 42. A cylinder-shaped screw hole portion 46 which is connected to the axle cover 38 is inserted into the screw fixation hole 42 of this locking portion 44, and screw-fixed. Thus, the trailing arm 2 is held between the axle cover 38 and the locking portion 44 at the rear end 32 thereof, and rotationally fixed. The rear wheel tire 7 is screw-fixed to an end portion of the axle 6 inside the axle cover 38 by a nut 41. Accordingly, the vertical motion of the rear wheel tire 7 is transmitted to the trailing arm 2 through the axle 6 and the axle cover 38.

The aforementioned construction has been described about one of the rear wheels of the vehicle body 4, but is not limited to the rear wheel on one side, and applied to both of the rear wheels at the same time.

In the above construction, a case in which an automobile which is a running toy providing with the running toy suspension system 1 according to the present invention runs on the road surface having a convex portion will now be studied.

In general, the load of the vehicle body 4 is applied to the bushings 12 and the vehicle body covers 18, as well as washer screws 26 and compression springs 8 during running. Here, the bushings 12 are allowed for only rotation, so that the positions of the trailing arms 2 are determined by the balance of vehicle weight and spring force with the spring constant of the compression springs 8.

Next, a case in which the rear wheels of the running toy according to the present invention tip over the convex portion will now be described. In this case, the force to push the rear wheel tires 7 upwardly from the convex portion acts, so that the trailing arms 2 are pushed up, and the compression springs 8 are compressed to absorb the force thereof. Then, the rear wheel tires 7 climb down after they have climbed over the convex portion, so that the trailing arms 2 also climb down to release the compression of the compression springs 8.

Furthermore, a case in which the rear wheels of the running toy according to the present invention tip over a concave portion will now be described. In this case, the force to push the rear wheel tires 7 downwardly from the concave portion acts, so that the trailing arms 2 are pushed down, the compression springs 8 are released, and the bottom portions 28 in the middle of the trailing arms 2 are locked by being brought into contact with the hollow cylinder supporting portions 30, the hollow cylinder supporting portions 30 provided in the lower side portions of the hollow cylinders 24. Then, the rear wheel tires 7 are elevated again after they have tipped over the concave portion, so that the trailing arms 2 are also elevated and the compression springs 8 are compressed.

The present embodiment such as being described above, has the following effects.

First, the running toy suspension system according to the present invention provides the supporting walls 14 and the hollow cylinders 24 provided in the vehicle body, and is composed of the trailing arms 2, the compression springs 8, and the washer screws 26. Accordingly, less components require less manufacturing processes and eliminate the necessity of special materials, thus enabling low-cost production.

In addition, the gearbox 36 falls into a different construction from the trailing arms 2, thereby making it possible to reduce effects on moment of inertia of the trailing arms 2.

Moreover, replacing spring materials, and the like of the compression springs 8 allows the running toy suspension system in the present invention to be adjusted by a change in the tightening force of the washer screws 26 which fix the compression springs 8 in addition to the change in the spring constant, as a method of adjustment thereof. More specifically, increase in the tightening force suppresses absorption of vibrational energy and decreases vibrational time, whereas decrease in the tightening force increases the absorption of the vibrational energy, as well as extends the vibrational time.

In addition, making the trailing arms 2 independent of the gearbox 36 has increased independency of the behavior of the right-and-left trailing arms 2, for example, it makes easier to absorb the vibration produced only in one side of the wheels.

Note that it is to be understood that the present invention is not limited to said embodiment, and that modifications and improvement within the scope of achieving the objects of the present invention are embraced in the present invention. For example, in said embodiment, the materials of the compression springs 8 are not limited to coil springs made of metal, and may employ even metal, such as carbon steels, alloy steels, copper alloys, nickel alloys, air springs, oil dampers, and leaf springs.

Also, bearings may be employed for combinations of the bearings 16 and the bushings 12.

Furthermore, the hole portions 20 are disposed in the approximately middle of the trailing arms 2, but not limited to the location thereof, and the distance to the axles 6 may be extended or shortened.

The invention claimed is:

1. A running toy having a plurality of front wheels for steering and a plurality of rear wheels having an axle connected to a running gear, a trailing arm comprising:

a first end portion which is pivotally supported on an upper portion of a supporting wall on a vehicle body of a running system at one end thereof;

a first hole portion, which is provided in a central portion of a trailing arm, a protruding hollow cylinder portion passing through said first hole portion, and the protruding hollow cylinder portion being provided on said vehicle body with a predetermined space from the supporting wall, a spring portion which acts between an adjustable screw provided on the top of the hollow cylinder portion and an end portion of the first hole portion; and a second hole portion which opens in a horizontal direction at the other end of said trailing arm, wherein said axle passes through said second hole portion and said spring absorbs shocks transmitted from the axle of the rear wheels.

2. The running toy according to claim 1, wherein at said first end portion of the trailing arm, a bushing projects in a horizontal direction and is received pivotally in a U-shaped groove provided on upper portions of two supporting walls provided on the vehicle body.

3. The running toy according to claim 1, wherein the trailing arm is provided with the hole portion passing through in a vertical longitudinal direction in the middle thereof, the hole portion having the same diameter as that of the hollow cylinder in a lower portion, and, in an upper portion, a larger diameter than that of the lower portion, and wherein the lower portion opens and covers a vehicle body, whereas the upper portion opens in the other side of the vehicle body, and a stepped portion is provided therebetween.

4. The running toy according to claim 3, wherein the spring acts between the stepped portion of the first hole portion and said adjustable screw.

5. The running toy according to claim 1, wherein trailing arms are disposed at both ends of a rear portion of the vehicle body, and a gearbox to change gears of the running gear is disposed between both the trailing arms.

6. The running toy according to claim 1, wherein the trailing arm is rotationally held between an axle cover extending from the gearbox, and the gearbox.

7. A running toy suspension system having a plurality of front wheels for steering and a plurality of rear wheels having an axle connected to a running gear, a trailing arm comprising:

a first end portion which is pivotally supported on an upper portion of a supporting wall on the vehicle body of the running system at one end thereof;

a first hole portion, which is provided in a central portion of said trailing arm, a protruding hollow cylinder portion passing through said first hole portion, and the protruding hollow cylinder portion being provided on said vehicle body with a predetermined space from the supporting wall;

a spring portion which acts between an adjustable screw provided on the top of the hollow cylinder portion and an end portion of the first hole portion; and a second hole portion which opens in a horizontal direction at the other end of said trailing arm, wherein said axle passes through said second hole portion and said spring absorbs shocks transmitted from the axle of the rear wheels.

8. The running toy suspension system according to claim 7, wherein at said first end portion of the trailing arm, a bushing projects in a horizontal direction and is received pivotally in a U-shaped groove provided on upper portions of two supporting walls provided on the vehicle body.

9. The running toy suspension system according to claim 7, wherein the trailing arm is provided with the hole portion passing through in a vertical longitudinal direction in the middle thereof, the hole portion having the same diameter as that of the hollow cylinder in a lower portion, and, in an upper portion, a larger diameter than that of the lower portion, and wherein the lower portion opens and covers a vehicle body, whereas the upper portion opens in the other side of the vehicle body, and a stepped portion is provided therebetween.

10. The running toy suspension system according to claim 9, wherein the spring acts between the stepped portion of the first hole portion and said adjustable screw.

11. The running toy suspension system according to claim 7, wherein trailing arms are disposed at both ends of a rear portion of the vehicle body, and a gearbox to change gears of the running gear is disposed between both the trailing arms.

12. The running toy suspension system according to claim 7, wherein the trailing arm is rotationally held between an axle cover extending from the gearbox, and the gearbox.

* * * * *